US006352059B2

(12) United States Patent
Stolk et al.

(10) Patent No.: US 6,352,059 B2
(45) Date of Patent: Mar. 5, 2002

(54) DEVICE FOR OPERATING A GAS EXCHANGE VALVE OF AN INTERNAL COMBUSTION ENGINE

(75) Inventors: Thomas Stolk, Kirchhelm; Alexander von Gaisberg, Fellbach, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/775,757

(22) Filed: Feb. 5, 2001

(30) Foreign Application Priority Data

Feb. 5, 2000 (DE) ..... 100 05 247

(51) Int. Cl.[7] ..... F01L 9/04; F01L 1/20

(52) U.S. Cl. ..... 123/90.11; 123/90.52; 251/129.1; 251/129.16

(58) Field of Search ..... 123/90.11, 90.52, 123/90.55; 251/129.01, 129.1, 129.15, 129.16

(56) References Cited

U.S. PATENT DOCUMENTS 4,777,915 A * 10/1988 Bonvallet ..... 123/90.11
5,762,035 A * 6/1998 Schebitz ..... 123/90.11
5,887,553 A * 3/1999 Ballmann et al. ..... 123/90.11
6,047,673 A * 4/2000 Lohse et al. ..... 123/90.11
6,085,704 A * 7/2000 Hara ..... 123/90.11
6,116,570 A * 9/2000 Bulgatz et al. ..... 251/129.1
6,257,182 B1 * 7/2001 Hara et al. ..... 123/90.11

FOREIGN PATENT DOCUMENTS

DE 35 13 107 C2 10/1986
DE 39 20 931 A1 1/1991
DE 39 20 976 A1 1/1991

* cited by examiner

*Primary Examiner*—Weilun Lo
(74) *Attorney, Agent, or Firm*—Klaus J. Bach

(57) ABSTRACT

In a device for operating a gas exchange valve of an internal combustion engine having an electromagnetic actuator including a valve opening magnet and a valve closing magnet, between which there is arranged an armature which, together with an opening spring, engages a valve stem against the force of a closing spring, and a hydraulic play-compensating element is arranged in the valve operating force transmission structure, the hydraulic play-compensating element is installed in the transmission structure together with a mechanical adjusting element providing for minimal valve play when the engine is shut down.

6 Claims, 3 Drawing Sheets

DEVICE FOR OPERATING A GAS EXCHANGE VALVE OF AN INTERNAL COMBUSTION ENGINE

BACKGROUND OF THE INVENTION

The invention relates to a device for operating a gas exchange valve of an internal combustion engine with an electromagnetic actuator which includes an opening magnet and a closing magnet and an armature movably disposed between the opening and closing magnets for operating a valve shaft against the force of a closing spring.

Electromagnetic actuators for actuating gas exchange valves usually have two operating magnets, a valve opening magnet and a valve closing magnet, with opposite pole faces between which an armature is arranged. The armature acts directly or indirectly on a valve stem of the gas exchange valve. Actuators operating in accordance with the principle of mass-oscillation include a spring mechanism, wherein two springs act on the armature in opposite directions. Usually, two pre-stressed compression springs are used as the spring mechanism, of which one is a valve opening spring which biases the gas exchange valve in the valve opening direction and the other is a valve closing spring, which biases the gas exchange valve in the valve closing direction. When the magnets are not excited, the armature is retained by the valve springs in a position of equilibrium between the two magnets. This position corresponds to a center position, that is an equilibrium position of energy, between the two springs.

DE 35 13 107 C2 discloses a gas exchange valve with an actuator in which the armature, together with an opening spring, acts on the valve stem, via an armature tappet, against the force of a closing spring, which acts on the valve stem of the gas exchange valve.

DE 39 20 931 A1 discloses an electromagnetic actuator for gas exchange valves of displacement engines, in particular of internal combustion engines, which operates one or more gas exchange valves via a lever mechanism. The lever mechanism provides for a variable motion transmission between the actuator and the gas exchange valve. A play-compensating element compensates for the play, which is caused by the transmission system or which develops therein. The play-compensating element may be arranged in various positions in the transmission system either on the side of the gas exchange valve or on the side of the magnet, e.g. between the support structure of the lever system or between the closing magnet and the housing. The play compensation arrangement also includes a structure common to the gas exchange valve, or individual adjustment devices for changing the transmission ratios and to adapt the position of equilibrium of the oscillating system to the new spring forces by changing the position of one or more spring support points.

DE 39 20 976 A1 discloses a similar adjusting device in which a hydraulic play-compensating element is supported in the armature and engages the valve stem of the gas exchange valve. The play-compensating element may be supplied with oil under pressure via the armature. Also provided is a setting screw which is inserted in a top cover and acts on one support point of an opening spring which, with its other support point, engages the armature. By virtue of the setting screw, the position of equilibrium of the armature is adjustable such that the armature rests in the center between the operating magnets when the magnets are de-energized.

When the internal combustion engine is at a standstill, the hydraulic play-compensating element empties whereby the pre-determined position of equilibrium is changed in the direction toward the opening magnet. When the internal combustion engine is then started up again, the closing magnet has to generate a relatively high force. This causes a high mechanical, electrical and thermal load. Furthermore, in the closed position of the armature, there is a relatively large gap between the play-compensating element and the valve stem, which results in an annoying noise. In many cases, oscillation excitation of the system is not possible.

It is the object of the invention, to improve the start-up capabilities of an internal combustion engine controlled via electromagnetic actuators.

SUMMARY OF THE INVENTION

In a device for operating a gas exchange valve of an internal combustion engine having an electromagnetic actuator including an opening magnet and a closing magnet, between which there is arranged an armature which, together with an opening spring, engages a valve stem against the force of a closing spring, and a hydraulic play-compensating element arranged in the valve operating force transmission structure, the play-compensating element is installed in the transmission structure together with a mechanical adjusting element providing for minimal valve play when the engine is shut down.

The mechanical play compensating element compensates for all deviations or tolerances resulting from the manufacture so that the hydraulic play-compensating element need only compensate for the changes in length resulting from the operation of the internal combustion engine. As a result, any gap between the play-compensating element and the adjacent component is minimal when the engine is started up again after stand-still, with the result that no significant noise or excessive mechanical, electrical or thermal loading is generated. Operation of the internal combustion engine is possible however also with a defective mechanical play-compensating element.

The adjusting element may simply comprise an adjusting disc, an eccentric shaft or a setting screw. It may be arranged at various locations of the device, so that there is a high level of design freedom.

Further embodiments and advantages of the invention will become apparent from the following description of the invention on the basis of the accompanying drawings.

DESCRIPTION OF PREFERRED EMBODIMENTS

Figure 1:
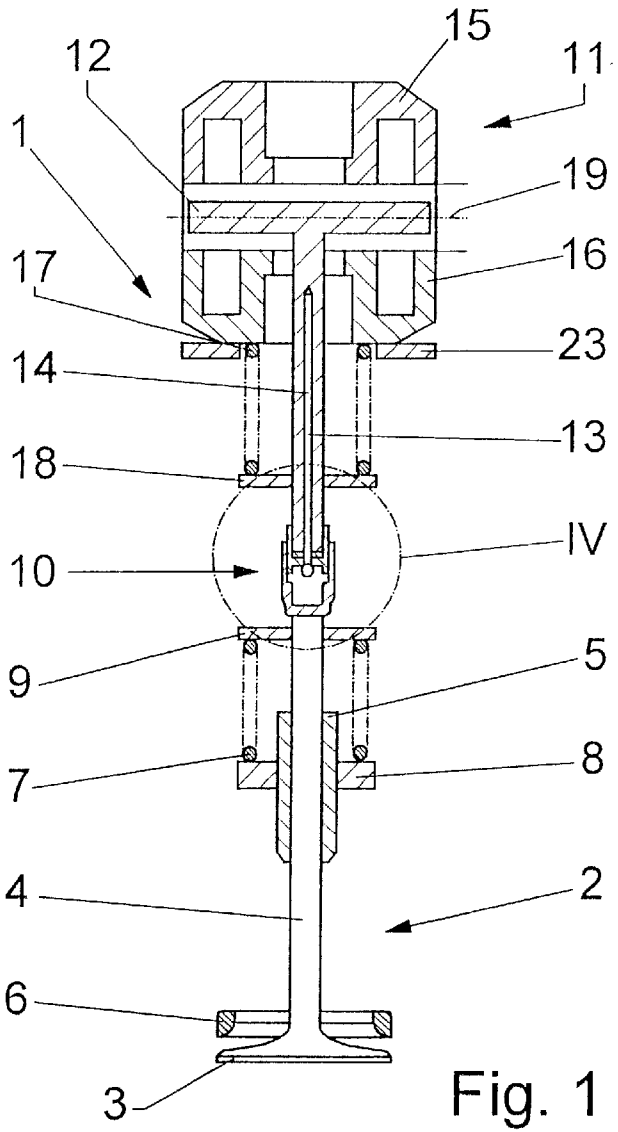
FIG. 1 shows, schematically, a device according to the invention having a hydraulic play-compensating structure shown in a position as it is during operation of the internal combustion engine or shortly after the engine has come to a standstill.

In the arrangement 1 of the invention as shown in FIG. 1, an electromagnetic actuator 11 operates a gas exchange valve 2 in the cylinder head 33 (FIG. 5) of an internal combustion engine. The actuator 11 has a top closing magnet 15 and a bottom opening magnet 16 as well as an armature 12, which is arranged axially movably between the magnets 15 and 16. The armature 12 acts on a valve stem 4 of the gas exchange valve 2 via an armature tappet 13 and a play-compensating element 10. Located at the free end of the valve stem 4 is a valve disc 3, which interacts with a valve seat ring 6 positioned in the cylinder head 33. A valve guide 5 guides the valve stem 4 in the cylinder head 33. For the sake of clarity, the cylinder head 33 has not been illustrated in FIGS. 1–4.

A pre-stressed spring system, comprising a valve closing spring 7 and a valve opening spring 17, retains the armature 12 in a position of equilibrium when the magnets 15, 16 are de-energized. The position of equilibrium corresponds generally to a center position 19 with regard to the energy of the two springs 7 and 17. The closing spring 7 is supported at one end, on the cylinder head 33 via a spring support structure 8 and, at the other end, on the valve stem 4 via a closing spring support plate 9. The opening spring 17 is supported, at one end, on the actuator 11 and, at its other end, on the armature tappet 13 via an opening spring plate 18.

FIG. 1 shows the armature 12 during engine operation in the center position 19 between the two magnets 15 and 16. During engine operation the play-compensating element 10 is activated and ensures that the gas exchange valve 2 closes in a play-free manner. Then in the closed position 21, that is, with the gas exchange valve 2 closed, the armature 12 butts against the closing magnet 15. The closing spring 7, which is pre-stressed, engages the gas exchange valve 2 with a predetermined closing force.

The play-compensating element 10 includes a cylinder 24 which butts against the valve stem 4 and in which a piston 25 is arranged in an axially movable manner. Together with the cylinder 24, the piston 25 forms a pressure space 26. Located in the latter is a spring 30 which biases the piston 25 against the armature tappet 13, which is disposed in a recess 31 at the free end side of the piston 25. The pressure space 26 is connected to an oil supply via a connection bore 14 in the armature tappet 13 and a connecting bore 27 in the piston 25. A ball 28, which is biased into a bore closing position by a spring 29 forms a check valve opening in the direction of the pressure space 26. It controls fluid flow from the connecting bore 27 out of the pressure space 26 valve. If the pressure prevailing in the pressure space 26 is lower than in the connecting bore 27, because, for example, the valve disc 3 butts against the valve seat ring 6 before the armature 12 reaches the closing magnet 15, the ball 28 is unseated against the force of the spring 29 and oil flows into the pressure space 26. In this way, the piston 25 is adjusted axially until the armature 12 engages the closing magnet 15 when the gas exchange valve 2 is closed.

Figure 2:
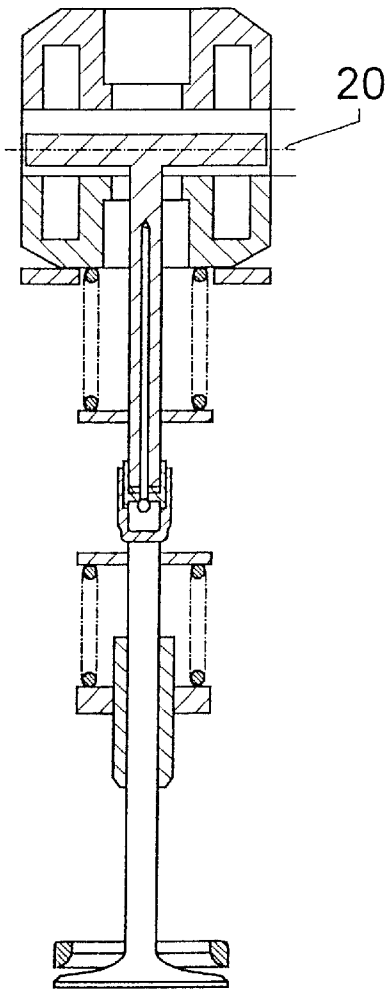
FIG. 2 shows a device according to FIG. 1 while the internal combustion engine is at a standstill and the oil has drained from the hydraulic play-compensating structure.

When the internal combustion engine is at a standstill, the valve closing spring 7 and the valve opening spring 17 subject the play-compensating element 10 to a loading, whereby the oil escapes from the pressure space 26 via throttle gaps provided (but not illustrated specifically). As a result, the play-compensating element 10 is compressed to the fullest extent. Accordingly, the position of equilibrium 20 of the armature 12 is changed in the direction toward the opening magnet 16 (FIG. 2). This means that, when the internal combustion engine is started up again, a gap 22 is formed between the play-compensating element 10 and the valve stem 4 when the armature 12 is located in a closed position 21 (FIG. 3) and the armature engages the closing magnet 15. The gap 22 makes correct functioning of the gas exchange valve 2 more difficult or disrupts operation completely. According to the invention, minimal valve play is therefore set during the installation by an adjusting element in the form of an adjusting disc 23, 32, 37, 39 or in the form of a setting screw 35. For this purpose, the distance between the parts adjacent to the play-compensating element 10, e. g. the distance between the valve stem 4 and the armature tappet 13, is measured when the valve 2 is closed and the armature 12 engages the closing magnet 15. The fully compressed length of the play-compensating element 10 is subtracted from this measurement. The remainder gives the desired thickness of the adjusting discs 23, 32, 37, 39 plus a minimal valve play. The setting screw 35 is to be turned accordingly. Instead of the adjusting disc 23, 32, 37, 39 or the setting screw 35, it is also possible to use other mechanical adjusting elements, e.g. an eccentric shaft (not illustrated specifically) or the like. The adjusting elements 23, 32, 37, 39 may be arranged in any desired position in the force transmission path of the play-compensating element 10.

Figure 3:
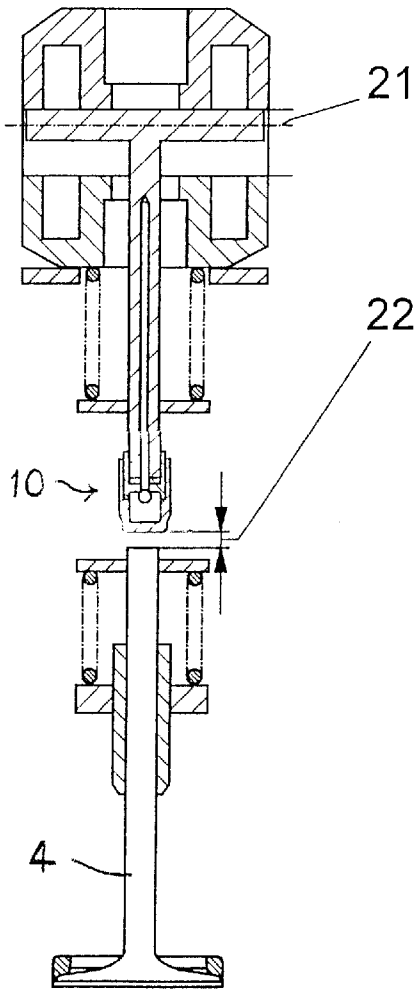
FIG. 3 shows a device according to FIG. 1 of the internal combustion engine immediately after start-up before the hydraulic play compensation structure has been readjusted.
Figure 4:
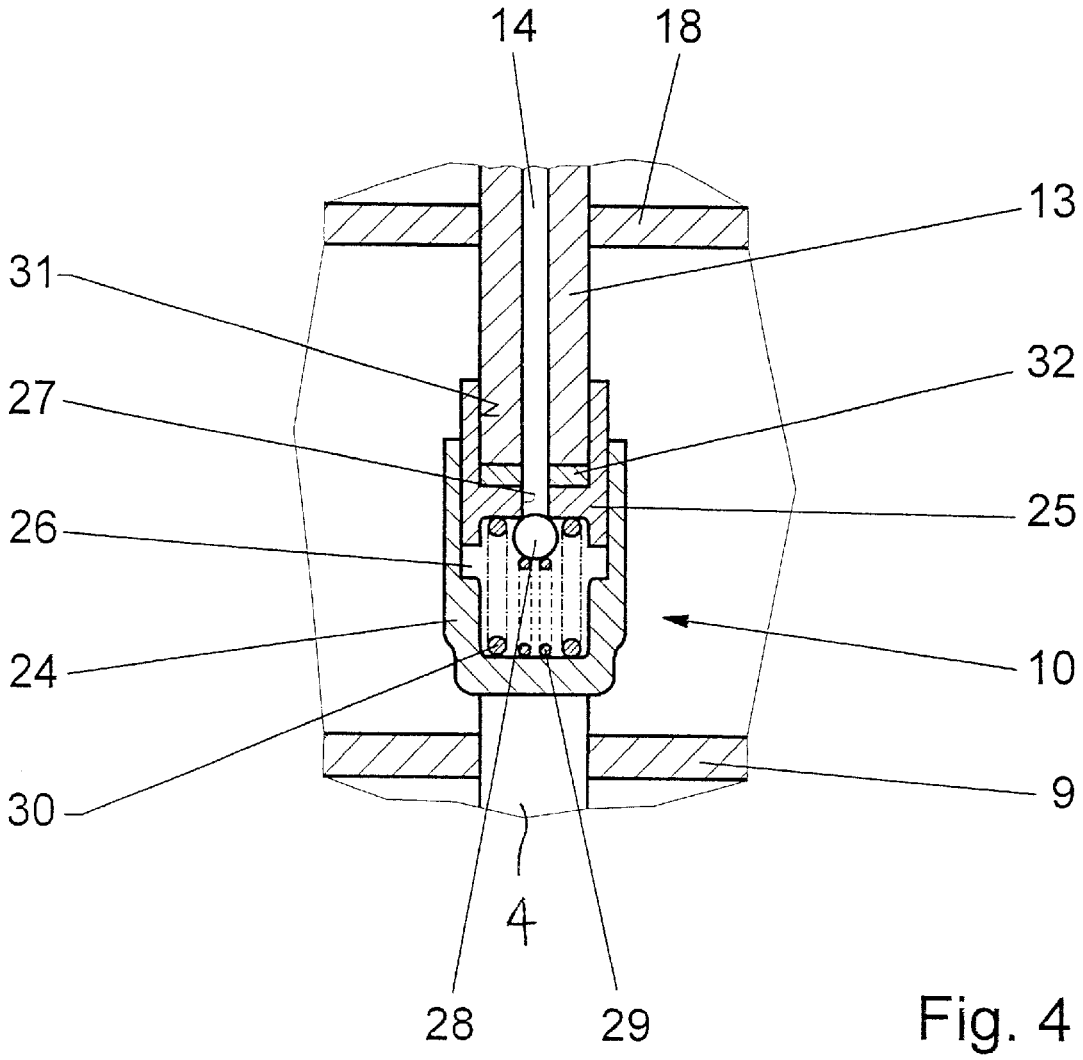
FIG. 4 shows an enlarged detail area as indicated by the circle IV in FIG. 1.
Figure 5:
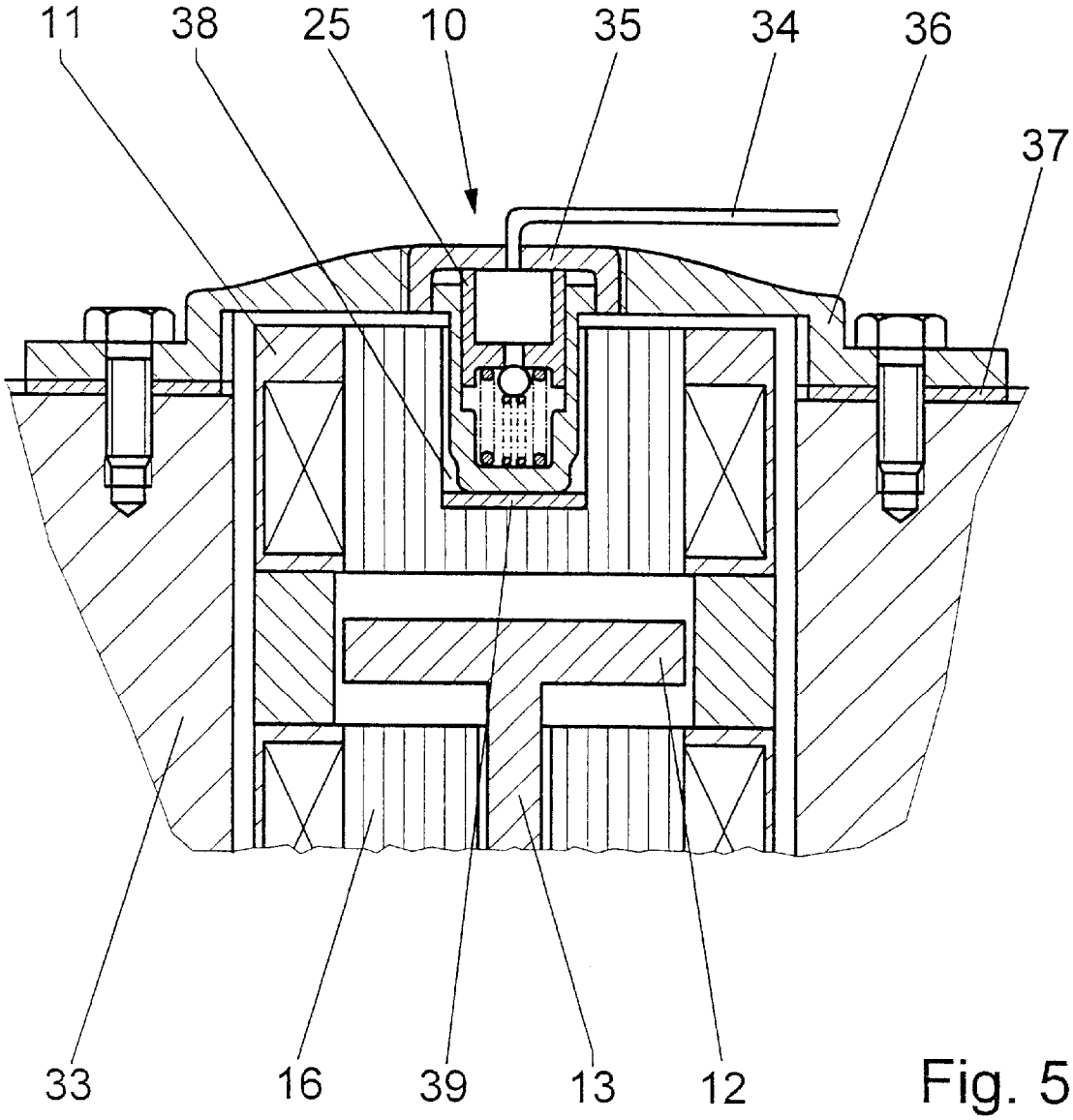
FIG. 5 shows, in detail, another embodiment of the invention, that is, a variant from the arrangement of FIG. 1.

In the embodiments according to FIGS. 1 to 3, an adjusting disc 23 is provided beneath the opening magnet 16. It is alternatively possible to arrange an adjusting disc 32 in the opening 31 of the piston 25 of the play-compensating element 10 (FIG. 4). In the exemplary embodiment according to FIG. 5, three alternatives are illustrated. The first alternative consists of an adjusting disc 37, which is installed between a securing means in the form of a cover 36 and the cylinder head 33. Further, the actuator 11, which is arranged in a floating manner in the cylinder head 33, may be supported on the cover 36 via the play-compensating element 10. As an alternative to the adjusting disc 37, it is possible to provide a setting screw 35 in the cover 36, the play-compensating element 10 being supported on the setting screw 35. As a third alternative, an adjusting disc 39 may be positioned between the actuator 11 and the play-compensating element 10 may be supported thereon. Hydraulic fluid is fed to the play-compensating element 10 via a supply line 34.

With a proper selection of the adjusting elements 23, 32, 37, 39, the internal combustion engine can be started up again with a minimal gap 22 so that the loading of the components and development of noise are minimized.

What is claimed is:

1. A device for operating a gas exchange valve with a valve stem of an internal combustion engine, having an operating mechanism with an electromagnetic actuator including a valve opening magnet and a valve closing magnet arranged in axially spaced relationship, an armature movably disposed between said valve opening and closing magnets, a valve opening spring acting on said valve stem in a valve opening direction and a valve closing spring acting on said valve stem in a valve closing direction against the force of said valve opening spring and a hydraulic play-compensating element arranged in said device for adjustment of the play in said operating mechanism, and a mechanical play-compensating element selected and installed in said operating mechanism during assembly of said device so as to provide minimal valve play when said internal combustion engine has just begun operation.

2. A device according to claim 1, wherein said mechanical play-compensation element is one of an adjustment disc and a setting screw.

3. A device according to claim 1, wherein said electromagnetic actuator is movably supported in a housing of said internal combustion engine via said mechanical play-compensating element, said mechanical play-compensation element being disposed between said actuator and said hydraulic play-compensating element.

4. A device according to claim 1, wherein said electromagnetic actuator is movably supported in a housing of said internal combustion engine via said mechanical play-compensating element, said mechanical play-compensation element being disposed between said hydraulic play compensating element and said housing.

5. A device according to claim 1, wherein said electromagnetic actuator is movably supported in a housing of said internal combustion engine via said mechanical play-compensating element, said mechanical play-compensation element being disposed between a play compensating element securing means and said housing.

6. A device according to claim 1, wherein said armature acts on the valve stem of said gas exchange valve via an armature tappet, and said hydraulic play-compensating element is arranged between the armature tappet and the valve stem and has an end recess in which said mechanical adjusting element is disposed, said armature tappet being supported on said mechanical adjusting element.

* * * * *